US005284164A

United States Patent [19]

Andrews et al.

[11] Patent Number: 5,284,164

[45] Date of Patent: Feb. 8, 1994

[54] METHOD FOR IMPROVING THE QUALITY OF PRODUCTS PRODUCED IN THE CIGARETTE MANUFACTURING PROCESS

[75] Inventors: Evelyn M. Andrews; Gregory J. Bricker, both of Macon; Ernest E. Collins, Gray; John N. Jewell; Dennis L. Sinksen, both of Macon; Darrel R. Stephens, Lizella; Charles H. Wysowski, Bonaire, all of Ga.

[73] Assignee: Brown & Williamson Tobacco Corporation, Louisville, Ky.

[21] Appl. No.: 789,235

[22] Filed: Nov. 7, 1991

[51] Int. Cl.[5] ..... A24C 5/32

[52] U.S. Cl. ..... 131/280; 131/908; 131/910; 364/552; 364/556; 493/4; 493/37

[58] Field of Search ..... 131/280, 908, 910; 364/550, 552, 556; 493/4, 37

[56] References Cited

U.S. PATENT DOCUMENTS

| | | | |
|---|---|---|---|
| 3,720,815 | 3/1973 | Lorenzen | 364/552 X |
| 3,946,212 | 3/1976 | Nakao et al. | 364/552 |
| 4,280,187 | 7/1981 | Reuland et al. | 364/552 |
| 4,724,429 | 2/1988 | Millen et al. | 131/910 X |
| 5,134,574 | 7/1992 | Beaverstock et al. | 364/552 |

*Primary Examiner*—Vincent Millin
*Assistant Examiner*—William M. Pierce
*Attorney, Agent, or Firm*—Charles I. Sherman

[57] ABSTRACT

The present invention comprises a method for improving the quality of products produced in a cigarette manufacturing process. Selected machine operating parameters for at least one machine are monitored, as well as the product being produced. Samples of the product being produced are automatically obtained and tested for quality parameters. Machine operators are notified when to manually test samples of the product for quality parameters. The machine operators can request a test of a quality parameter. The actual test measurements of the quality parameters for either the automatically obtained samples or the manually tested samples are compared against expected values and alarms are presented and the testing is resequenced when the measured quality parameters fail to meet the expected values. Also, employee solution procedures are presented to aid in problem resolution. The time periods and downtime reason when each machine is inoperative is recorded. A hierarchial set of machine operator video displays is produced. A master video display is presented to each machine operator. Also, displays are available for the machine supervisors showing information about all the machines he is supervising. Further, machines can be monitored by sets of tandem machines operating together.

18 Claims, 3 Drawing Sheets

METHOD FOR IMPROVING THE QUALITY OF PRODUCTS PRODUCED IN THE CIGARETTE MANUFACTURING PROCESS

BACKGROUND OF THE INVENTION (a) Field of the Invention

The present invention relates to a method for improving the quality of products produced in the cigarette manufacturing process. By having a computer monitor operating parameters of a machine while it is producing a particular product; automatically perform or request that the machine operator perform various quality tests on samples of the product being produced; compare the machine parameters and the test results to expected values; and provide rapid feedback to the machine operator using interactive video displays which easily highlight problems, allow the operator to analyze the problems, and can provide recommended solutions to the problems, the real time quality control of products being produced for use in cigarette manufacturing can be greatly improved.

(b) Description of the Prior Art

There is a great need in industry to provide feedback as rapidly as possible to machine operators in order to minimize product which fails to meet quality standards. This is particularly true in the cigarette manufacturing industry, where tremendous quantities of product can be produced in a very short time period. For example, cigarette filter rod machines generally produce filter rods at a rate in excess of 3500 rods per minute. In the past, machine operators performed manual measurements of the quality of the product they were producing and manually recorded the results on a control chart. Quality control personnel would gather the test results and perform statistical calculations to determine the quality of the product being produced. This process was very time consuming, and, if there were quality problems, large quantities of product might have to be discarded. Because of this time delay, the product might have already been used further in the production cycle, so the waste could be even more costly. Therefore, it was desirable to develop a method whereby rapid feedback is given to the machine operators concerning the quality of the product they are producing so that they can make adjustments and minimize product waste. Further, it was desirable to make this method operator friendly to minimize training and encourage use in the work place. Also, it was desirable to provide the operators with suggested solutions for the problems they encountered. The present invention satisfies these desires.

Others in the cigarette manufacturing process have taught procedures which relate to the present invention. U.S. Pat. No. 4,522,214, to Osmalov, teaches a method and apparatus for controlling a cigarette maker to produce a cigarette rod with predetermined moisture content, whereby a signal processor is used to monitor inputs from moisture, density, and firmness sensors and make adjustments in the cigarette making process based on those sensor inputs.

U.S. Pat. No. 5,044,379, to Cahill et al, teaches method to monitor quality parameters, weighting each parameter according to its importance, summing the weighted quality parameter test results, and adjusting the machine to keep the sum of the weighted quality parameter test results as close to the desired sum as possible.

SUMMARY OF THE INVENTION

The present invention is for a method for improving the quality of products produced in the cigarette manufacturing process. In the present invention, an operator friendly computer provides rapid feedback to machine operators concerning the quality of the product they are producing and the productivity of the machines producing the product, so that they can make adjustments to minimize product waste and increase efficiency. Further, the computer makes available to the machine operators possible solutions for the problems they encounter.

More particularly, the present invention provides a method whereby a computer monitors the operating parameters of a machine while it is producing a particular product; automatically performs or requests that the machine operator perform various quality tests on samples of the product being produced; compares the machine parameters and the test results to expected values; and provides rapid feedback to the machine operator using interactive video displays which easily highlights problems, allows the operator to analyze the problems, and can provide recommended solutions to the problems. One computer can monitor a number of machines. For example, one computer can monitor several filter rod making machines and provide feedback at each machine on the operation of that machine. At the same time, this computer can also be monitoring several machines which work in tandem, such as a cigarette making and cigarette packing machine, and provide feedback at each machine concerning the operation of the two machines being operated in tandem. Also, information concerning the operation of groups of machines, such as all filter rod making machines or the cigarette making and cigarette packing machines operating in tandem, can be displayed for use by a supervisor.

Finally, the present invention provides a method for improving the quality of products produced in a cigarette manufacturing process, which comprises the steps of: monitoring by a computer of selected operating parameters for at least one machine; tracking by said computer of a product being produced by said at least one machine; obtaining samples of the product being produced by said at least one machine as directed by said computer; testing quality parameters of the product; comparing by said computer the actual test measurements of the quality parameters against expected values; tracking by said computer for said at least one machine the time period and downtime reason when said at least one machine is inoperative; generating by said computer a hierarchial set of video displays to provide information to the operator of said at least one machine; and, displaying a master video display to the operator of said at least one machine.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
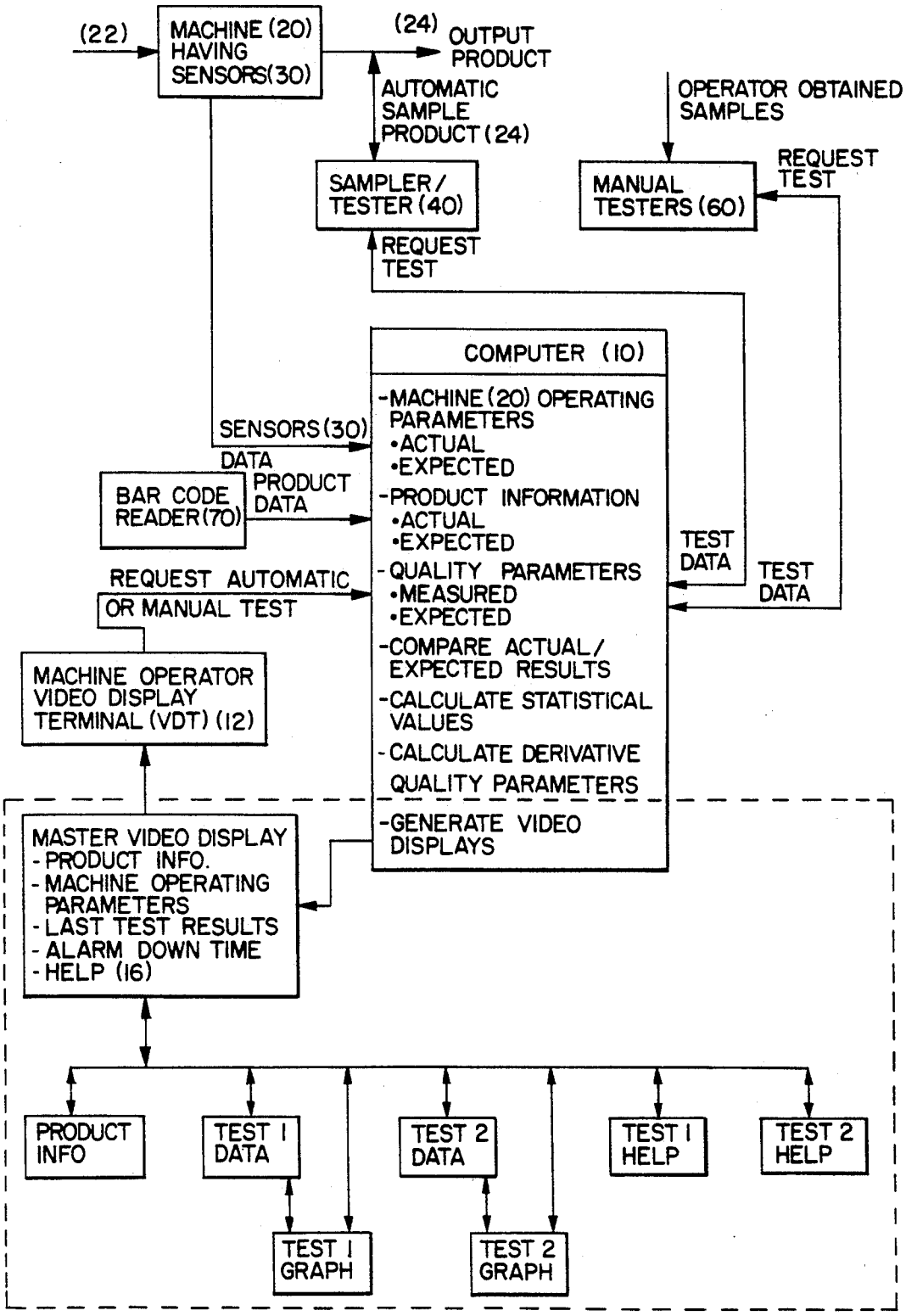
FIG. 1 shows a block diagram of one preferred computer of the present invention used to monitor a machine in a cigarette processing line.

The present invention is directed to a method for improving the quality of products produced in a cigarette manufacturing process. The cigarette manufacturing process comprises numerous machines which are utilized in making a commercially viable cigarette product. Some of these machines work alone producing a product to be used later in the manufacturing process. An example of this is the filter rod making machine. Other machines work in concert with each other, one machine producing one product which is then transferred to the other machine to be used to produce another product. An example of this is the cigarette making machine and the cigarette packing machine, where a specific cigarette is manufactured and then transported to a packing machine which is set-up with the corresponding cigarette package blanks in which to pack the cigarettes.

Most of the machines which are used in the cigarette industry have built-in sensors which measure some of the operational parameters of the machine. Also, some of the machines have measuring equipment in the production line which measures quality parameters of the product being produced. Additionally, standard off-line test devices exist which can be used by the machine operator to conduct quality tests. Also, automatic test devices are available which will take samples of the product and conduct quality tests. One goal of the present invention is to take advantage of the built-in sensors, in line measuring equipment, and automatic and manual off-line test devices to produce data which is then evaluated by a computer and expeditiously presented to a machine operator in a format such that the operator may instantaneously see how the machine is performing and may obtain assistance in solving production problems, if any exist.

Before referring to the figures for a detailed description of the method of the present invention, a description of typical parameters for selected processes in cigarette manufacturing is provided. In a filter rod making machine, such as the Hauni KDF-2/AF-2, sensors detect operational machine parameters such as roller speeds. Sensors also detect reasons for downtime when there is a malfunction, such as a rod break. Filter rod circumference, pressure drop, wet weight, dry weight, and percent of plasticizer are important quality parameters which are measured or derived from other measurements. As an example, Filtrona makes test instruments such as the ATCG and APD for measuring filter rod circumference and pressure drop, respectively.

In a cigarette making machine, such as the Hauni Protos Maker, sensors detect operational machine parameters such as speed of production and downtime reasons such as rod break. Cigarette weight is determined while the machine is in production, using, for example, an ABB weight control gauge. Cigarette circumference, ventilation, pressure drop, and weight are important quality parameters which are measured, using, for example, a Filtrona CTS-300 test instrument.

A cigarette packing machine, such as the GDX-1, also contains downtime and operational machine parameter sensors. Package seal is a quality parameter which is measured, using, for example, an ARJAY pack seal tester. The cigarette packing machine includes a packer which places the cigarettes in a pack, an overwrapper which places a cellophane-like wrap around the packaged cigarettes, and a cartoner which places overwrapped packs in cartons. The cartons are then cased. The method of the present invention can be used to improve quality and production efficiency in all of the production stages.

FIG. 1 shows a block diagram of how a computer 10 is used to monitor one machine 20, for example, a filter rod making machine. Computer 10 can be one mainframe computer, or any combination of networked computers which can be utilized to implement the method of the present invention. Machine 20 uses materials 22, such as, for example, filter tow and plasticizer, to produce an output product 24, such as, for example, filter rods. Computer 10 has a machine operator video display terminal (VDT) 12. VDT 12 has a computer monitor equipped with a touchscreen to ease the machine operator interface. Therefore, all machine operator interface with computer 10 is accomplished by having the machine operator touch the VDT 12 screen rather than use a keyboard.

In FIG. 1, machine 20 has sensors 30 which monitor machine operating parameters and machine downtime reasons. The output from sensors 30 is fed to computer 10. Although not shown in FIG. 1, machine 20 may also be provided with sensors in the production line which would continually monitor quality parameters of the product 24 being produced. This possibility will be discussed with the discussion of FIG. 3.

An automatic sampler/tester 40 is connected to machine 20 and computer 10. Computer 10 controls sampler/tester 40's operation. Upon a command by computer 10, sampler/tester 40 will obtain a sample of machine 20's output product 24 and test the sample for various quality parameters. The test results are then fed to computer 10. For example, in the production of filter rods, sampler/tester 40 interfaces with machine 20 using a device for receiving and transferring cylindrical filter rods from a mass flow of filter rods being conveyed, as described in copending U.S. patent application No. 493,267, filed on Mar. 14, 1990. Sampler/tester 40 is a Filtrona FTS-300 which tests filter rods for circumference and pressure drop.

One or more manual testers 60 are connected to computer 10. Computer 10 tracks the time when various manual quality tests were conducted and advises the machine operator via VDT 12 when another quality test should be accomplished. Computer 10 also responds to a request by the machine operator to accomplish an unscheduled quality test. Using VDT 12, the operator inputs to computer 10 which manual test is to be performed. Computer 10 then communicates with the appropriate manual tester 60 to obtain the test results. As an example, in the making of filter rods, manual testers 60 can be made available to the machine operator which will test circumference, pressure drop, dry weight, or wet weight. In practice, wet weight is the weight of a standard number of filter rods containing plasticizer, while dry weight is the weight of a standard number of filter rods without plasticizer. Computer 10 can also derive quality parameters. As an example, wet and dry weight measurements are used to determine the percent of plasticizer in the filter rods.

Computer 10 also is programmed to recognize the different materials 22 which are used for each different output product 24 and what the machine normal operating parameters are for each output product 24. Either the machine operator or a supervisor inputs to computer 10 what output product 24 is to be produced. Computer 10 can then display what the machine 20 operating parameters should be set to in order to produce the product 24. Computer 10 is also programmed to identify to the machine operator what materials 22 should be used. The machine operator can verify the correct materials 22, or by adding a device like bar code reader 70, the materials 22 can be scanned and computer 10 can confirm that the correct materials 22 are being used to produce the desired output product 24 and notify the operator if incorrect materials are scanned.

Computer 10 takes all of the data from the machine 20 sensors 30, the sampler/tester 40, the manual testers 60, the bar code reader 70, and its internal data files containing expected values for machine and quality parameters and materials 22 for each product 24 and prepares a group of hierarchial video displays for the machine operator and a supervisor.

Figure 2:
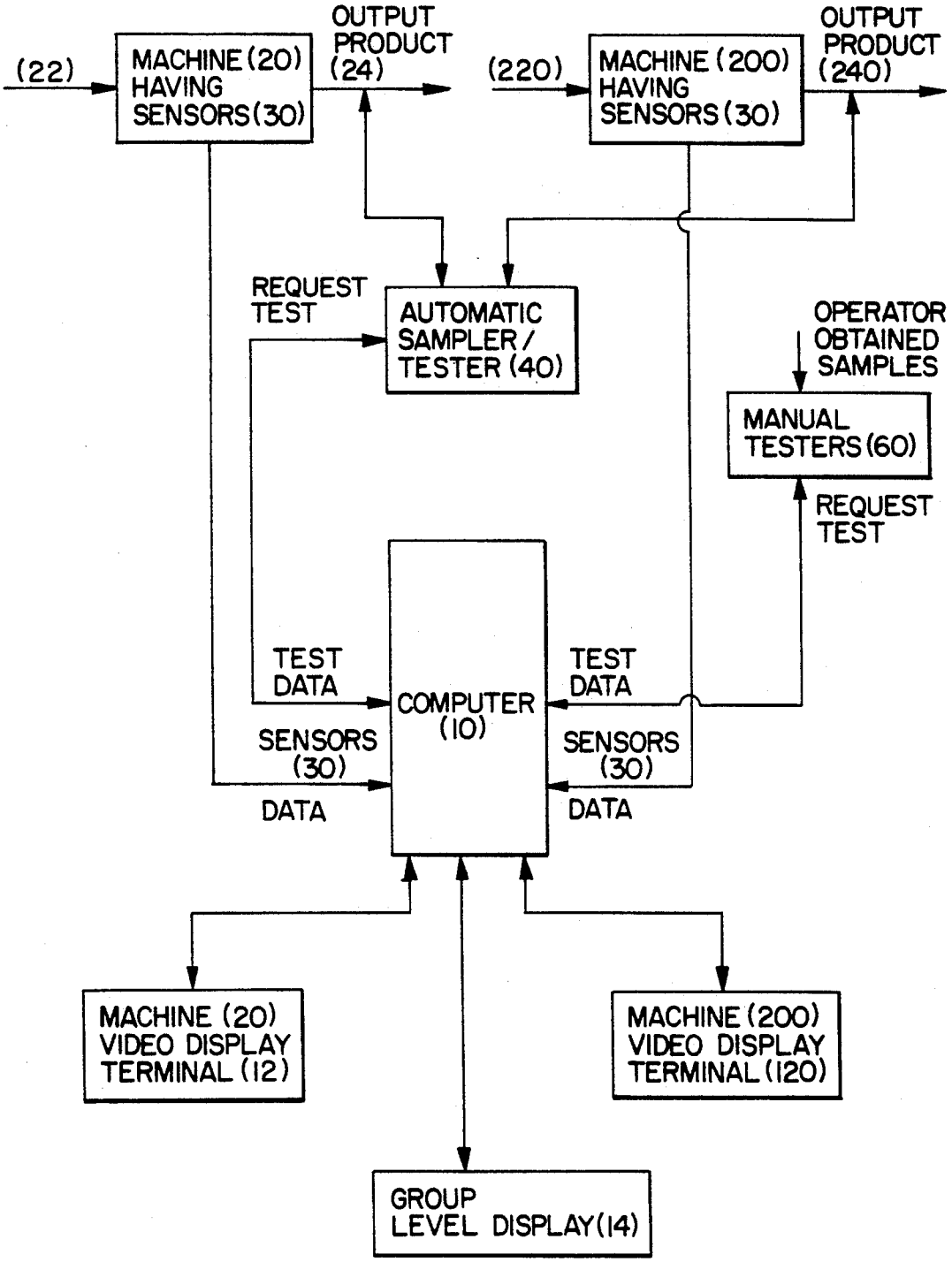
FIG. 2 shows a block diagram of one preferred computer of the present invention used to monitor a plurality of machines in a cigarette processing line; and, FIG. 3 shows a block diagram of one preferred computer of the present invention used to monitor two pair of machines operating in tandem in a cigarette processing line.

Before the method is described, it is necessary to understand how computer 10 is used with more than one machine 20. FIG. 2 shows a block diagram of how computer 10 is used to monitor two machines 20 and 200, but operationally any number of machines may be monitored using the same process as described for two machines.

In FIG. 2, machine 20 and machine 200 are producing a like product 24 and 240, respectively. For example, machine 20 could be producing filter rods for a standard circumference cigarette, while machine 200 could be producing filter rods for a slim cigarette. While the process of producing the filter rods would be the same, some different materials will be used and some machine operating parameters and some quality parameters will be different.

As shown, each machine 20 and 200 has its own machine operator VDT 12 and 120, respectively. Also, a group level display 14 is provided for a supervisor, which will allow the supervisor to monitor all machines 20 and 200 simultaneously and also access any of the machine operator hierarchial video displays.

Only one automatic sampler/tester 40 is used in this configuration. Depending on the quality tests to be performed and how often samples are to be tested, the addition of more machines to the system could necessitate additional sampler/testers 40. As an example, if it takes five minutes to perform a quality test on a sample of filter rods and if samples need to be tested every thirty minutes, then, the maximum number of machines which could be tested by one sampler/tester 40 would be six machines. Also, computer 10 and sampler/tester 40 could be responsive to machine operator or supervisor requests to accomplish additional automatic quality tests. If this is the case, then the number of machines connected to a sampler/tester 40 would be reduced.

With reference now to both FIGS. 1 and 2, a method for improving the quality of similar products produced by at least one machine used in the cigarette manufacturing process is described. For monitoring selected machine operating parameters for machines 20 and 200, computer 10 is electrically connected to sensors 30. For monitoring the product 24 and 240 being produced, the machine operator or the supervisor enters a product identification to computer 10 using respective VDT 12 or 120, or group level display 14. If monitoring the materials being used to produce the product 24 or 240 for machines 20 or 200, bar code reader 70 can be used by the machine operator to scan bar codes on the materials 22 and 220 used by machines 20 and 200, respectively. In the alternative, machine operators can simply verify that they are using the correct materials 22 or 220 by referring to the appropriate hierarchial video display on VDT 12 or 120, respectively.

For automatically obtaining samples of the product 24 or 240 being produced by machines 20 or 200 on a sequential basis, computer 10 tells sampler/tester 40 when it is time to obtain a sample and from which machine 20 or 200 to obtain that sample. For automatically testing quality parameters for the automatically obtained samples of the product 24 or 240, computer 10 directs sampler/tester 40 to conduct the appropriate quality tests when it has the correct sample size of product 24 or 240 and then computer 10 obtains the test results.

For notifying the operator of each of the one or more like machines 20 or 200 when it is time for the operator to manually test samples of their respective product 24 or 240 for quality parameters using manual testers 60, computer 10 is programmed to keep track of when the last sample was tested and, after a preset time interval, notifies the machine operator when to repeat each specific test.

For responding to a request by the operator of one of machines 20 or 200 to either automatically or manually test a requested quality parameter for a product sample using sampler/tester 40 or manual testers 60, respectively, computer 10 reacts to an operator request from VDT 12 or 120 which tells computer 10 which test is desired If sampler/tester 40 is to be used, computer 10 is programmed to prioritize this test among the sequential tests it is conducting on all of the at least one machine. Then, computer 10 will direct sampler/tester 40 to obtain the requested sample of product 24 or 240 and conduct the requested quality test. If manual testers 60 are to be used, computer 10 is programmed to receive the test results from the appropriate manual tester 60 for the test requested. A supervisor, using group level display 14, can also request a quality test using the appropriate sampler/tester 40 for any of machines that the supervisor is monitoring.

For comparing the actual test measurements of the quality parameters for either the automatically obtained samples or the manually tested samples against expected values, for computing statistical averages and standard deviations based on product test sample size, and for calculating derivative quality parameters which are derived from the data from more than one test, the appropriate computer programs are loaded into computer 10.

For resequencing the automatic sampling and testing of the products 24 and 240 from machines 20 or 200, respectively, when the measured quality parameters fail to meet the expected values, computer 10 is given a prioritized list of parameters. Then, depending on which parameters fail, computer 10 is programmed to resequence the order in which sampler/tester 40 obtains and tests samples 24 and 240 from machines 20 and 200, respectively.

Computer 10 uses its time clock for recording for each of the one or more like machines the time periods and downtime reason or alarm condition when the machine operating parameters fail to meet expected values, when there is a production malfunction causing the machine to cease production, or when the actual or derivative test measurements of the quality parameters fail to meet expected values.

Computer 10 is programmed for generating a hierarchial set of video displays to provide desired information to the operator of each machines 20 and 200. By displaying a master video display (16) to the operator of each of the machines 20 or 200, which, for the respective machine shows or displays: product information for the product currently being produced; selected current machine operating parameters; the last test results for the various measured and derivative quality parameters; out of tolerance conditions; the most important current alarm condition or downtime reason, if applicable; and a historical graph of the test data for the quality parameter for the most important current alarm condition, if applicable; thereby allowing the operator to touch appropriate points on the master display to retrieve additional video displays from the hierarchial set of video displays. The operators of machines 20 and 200 can instantaneously see how well their machine is performing and take immediate steps to correct any problems. The additional video displays provide more specific information concerning: the machine operating parameters for each product; the materials which should be used for each product; a summary of past alarm conditions; a summary of each of the past quality parameters tested or derived, shown as Test 1 and Test 2 Data; a graphical summary of the past statistical average and standard deviation for each of the past quality parameters tested or derived, shown as Test 1 and Test 2 Graph; a summary of the past downtime reasons; and, suggested employee solution procedures to correct problems or out of tolerance conditions, shown as Test 1 and Test 2 Help. These additional video displays can be hierarchially arranged by computer 10 in a most user friendly way for ease of operation.

As an example, the master display (16) could show that in a filter rod making machine, like machine 20, that the standard deviation for the filter rod circumference for the last sample of filter rods did not meet the expected value and could show a graph of the test data. The operator could touch VDT 12 on the screen at the location where the screen says "circumference". This could call up a screen which shows all circumference measurements made while making this product. The operator could request additional screens which show graphs of the test data so that the operator can see if the circumference test data has slowly moved to an out of tolerance condition or suddenly gone out of tolerance. If the operator is not sure of what actions to take to correct the problem, the operator can go to an employee solution procedures (ESP) display, which will give the operator a prioritized list of actions the operator can perform to correct the out of tolerance condition. The employee operator can access this ESP display from the master video display (16), the historical test data display, or the graphical display. Also, the operator can return to the master video display (16) from any of the displays lower in the hierarchy. Other displays are similarly configured by computer 10. For example, from the master video display (16), the machine operator could request a display which would show the reasons and times for all machine downtime during the current shift in order to see if there were repeating machine problems. The operator could then call up displays for previous shifts for the same machine to see if the same problems were occurring during those previous shifts.

Using group level display 14, a supervisor can access all of the hierarchial video displays for each of the one or more like machines that he is supervising. Also, computer 10 generates additional video displays for the supervisor. As an example, the supervisor's master video display can show each machine, the product it is producing, its current operational status, and the estimated output it will produce at the end of a shift based on its past performance.

Figure 3:
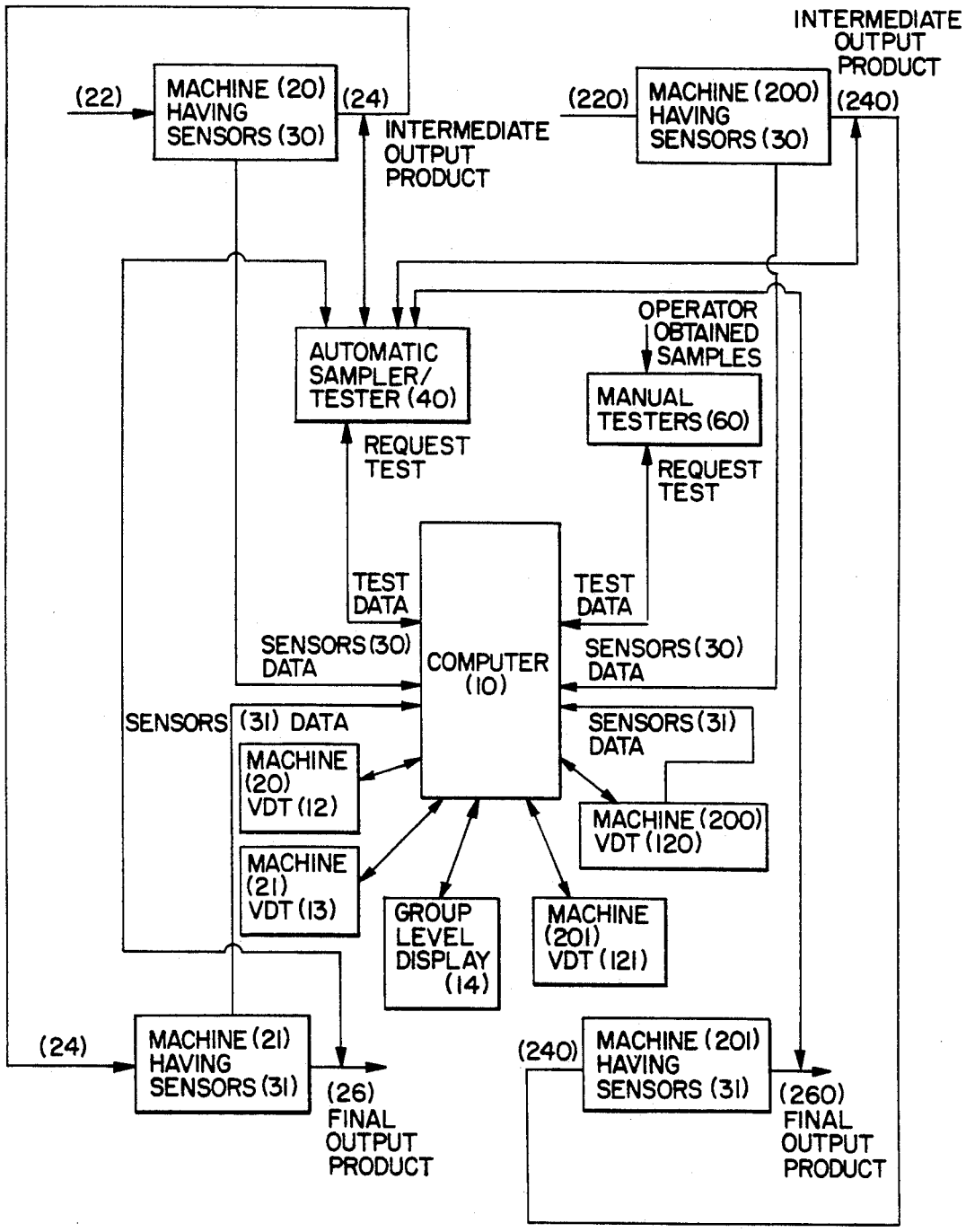

FIG. 3 shows a block diagram of how a computer could be used to monitor two pair of machines operating in tandem. In the cigarette industry, one machine makes one intermediary product which is used by another machine to produce another intermediary or final commercially sellable product. For example, a cigarette making machine will use appropriate materials, such as filter rods, paper, and tobacco, to make a certain cigarette. This cigarette is then fed to a cigarette packing machine which is set-up with package blanks for that cigarette to place the desired number of cigarettes in a sealed package. Since these machines work in tandem, the operation of each affects the output efficiency of the tandem system. Therefore, the operators of each machine and their supervisor need rapid feedback concerning machine operation and product quality in order to improve the quality and quantity of the product being produced. The method of the present invention provides this feedback.

In FIG. 3, machines 20 and 21 and machines 200 and 201 work in tandem. Each machine 20 and 200 has sensors 30 and each machine 21 and 201 has sensors 31. As previously discussed, these sensors detect machine operation and downtime. In addition, they can evaluate quality parameters during production without removing test samples from the production line. For example, in a cigarette making machine, an ABB weight control gauge checks the weight of cigarettes being produced. In a cigarette packing machine, video cameras can be utilized to ensure that the cigarette packages conform to the expected shapes and that the graphics on the packages are in the correct locations.

FIG. 3 shows one sampler/tester 40 connected to machines 20, 21, 200, and 201. Depending on the products being produced, each machine 20, 21, 200, and 201 may require a unique sampler/tester 40, or the like machines, 20/200 and 21/201, may share a sampler/tester 40. There will also be an appropriate number of manual testers 60 with the various machines 20, 21, 200, and 201 to perform the desired tests in any possible sequence.

A method for improving the quality of similar products produced by at least one group of machines operating in tandem used in the cigarette manufacturing process is described. For monitoring selected machine operating parameters for machines 20, 21, 200, and 201, computer 10 is electrically connected to sensors 30 of machines 20 and 200 and sensors 31 of machines 21 and 201. For monitoring the product 24, 26, 240, and 260 being produced, the machine operator of machines 20, 21, 200, or 201, respectively, or the supervisor enters a product identification to computer 10 using VDT 12, 13, 120, or 121, or group level display 14, respectively. If monitoring the materials being used to produce the product 24, 26, 240, or 260 for machines 20, 21, 200, or 201, a bar code reader, as was discussed with FIG. 1, can be used by the machine operator to scan bar codes on the materials. In the alternative, machine operators can simply verify that they are using the correct materials by referring to the appropriate hierarchial video display on their respective VDT 12, 13, 120, or 121.

For automatically obtaining samples of the product 24, 26, 240, or 260 being produced by respective machines 20, 21, 200, or 201 on a sequential basis, computer 10 is programmed to direct sampler/tester 40 when it is time to obtain a sample and from which machine 20, 21, 200, or 201 to obtain that sample. For automatically testing quality parameters for the automatically obtained samples of the product 24, 26, 240, or 260, computer 10 directs sampler/tester 40 to conduct the appropriate quality tests when it has the correct sample size of product 24, 26, 240, or 260 and then computer 10 obtains the test results.

For notifying the operator of each of the one or more like machines 20, 21, 200, or 201 when it is time for the operator to manually test samples of their respective product 24, 26, 240, or 260 for quality parameters using manual testers 60, computer 10 is programmed to keep track of when the last sample was tested and, after a pre-set time interval, notifies the machine operator when to repeat each specific test.

For responding to a request by the operator of one of machines 20, 21, 200, or 201 to either automatically or manually test a requested quality parameter for a product sample using sampler/tester 40 or manual testers 60, respectively, computer 10 reacts to an operator request from respective VDT 12, 13, 120, or 121 which advises computer 10 which test is desired. If sampler/tester 40 is to be used, computer 10 is programmed to prioritize this test among the sequential tests that sampler/tester 40 is conducting on all of the machines. When time to test, computer 10 will direct sampler/tester 40 to obtain the requested sample of product 24, 26, 240, or 260 and conduct the requested quality test. If manual testers 60 are to be used, computer 10 is programmed to receive the test results from the appropriate manual tester 60 for the test requested. A supervisor, using group level display 14, can also request a quality test using the appropriate sampler/tester 40 for any of machines that the supervisor is monitoring.

For comparing the actual test measurements of the quality parameters for either the automatically obtained samples or the manually tested samples against expected values, for computing statistical averages and standard deviations based on product test sample size, and for calculating derivative quality parameters which are derived from the data from more than one test, the appropriate computer programs are loaded into computer 10.

For resequencing the automatic sampling and testing of the products 24, 26, 240, and 260 from respective machines 20, 21, 200, and 201 when the measured quality parameters fail to meet the expected values, computer 10 is given a prioritized list of parameters. Then, depending on which parameters fail, computer 10 is programmed to resequence the order in which sampler/tester 40 obtains and tests samples of products 24, 26, 240, and 260 from machines 20, 21, 200, and 201, respectively.

Computer 10 uses its time clock for recording for each of the machines 21, 21, 200, and 201 the time periods and downtime reasons or alarm conditions when the machine operating parameters fail to meet expected values, when there is a production malfunction causing the machine to cease production, or when the actual or derivative test measurements of the quality parameters fail to meet expected values.

Computer 10 is programmed for generating a hierarchial set of video displays to provide desired information to the operator of each machines 20, 21, 200, and 201. In addition to providing the operator with information about his machine, computer 10 also provides him with information about the machine which is working in tandem with his machine. Therefore, the operators of machines 20 and 21 will see information about both machines, as will the operators of machines 200 and 201.

By displaying a master video display to the operator of each of the machines 20, 21, 200, and 201, which, for the respective machine and its tandem machine shows or displays: product information for the products currently being produced; selected current machine operating parameters; the last test results for the various measured and derivative quality parameters; out of tolerance conditions; and the most important current alarm condition or downtime reason, if applicable. The operator will then touch appropriate points on the master display to retrieve additional video displays from the hierarchial set of video displays and the operators of machines 20, 21, 200, and 201 can instantaneously see how well their machine and their tandem machines are performing and take immediate steps to correct any problems. The additional video displays provide more specific information concerning: the machine operating parameters for each product; the materials which should be used for each product; a summary of past alarm conditions; a summary of each of the past quality parameters tested or derived; a graphical summary of the past statistical average and standard deviation for each of the past quality parameters tested or derived; a summary of the past downtime reasons; and, suggested employee solution procedures to correct problems or out of tolerance conditions. These additional video displays can be hierarchially arranged by computer 10 in a most user friendly way for ease of operation.

As an example, the master display shown on VDT 12 and 13 could show that in a cigarette making machine, like machine 20, and in its tandem cigarette packing machine, like machine 200, that the tip vent rate standard deviation did not meet the expected value. Either operator of machine 20 or 200 could touch respective VDT 12 or 13 on the screen at the location where the screen says "vent rate too high". This could call up a screen which shows all vent rate measurements made while making this product. The operator could request additional screens which show graphs of the test data so that the operator can see if the vent rate test data has slowly moved to an out of tolerance condition or suddenly gone out of tolerance. If the operator is not sure of what actions to take to correct the problem, the operator can go to an employee solution procedures (ESP) display, which will give the operator a prioritized list of actions the operator can perform to correct the out of tolerance condition. The employee operator can access this ESP display from the master video display, the historical test data display, or the graphical display. Also, the operator can return to the master video display from any of the displays lower in the hierarchy. Other displays are similarly configured by computer 10. For example, from the master video display, the machine operator could request a display which would show the reasons and times for all machine downtime during the current shift in order to see if there were repeating machine problems. The operator could then call up displays for previous shifts for the same machine to see if the same problems were occurring during those previous shifts.

Using group level display 14, a supervisor can access all of the hierarchial video displays for all of the tandem machines that he is supervising. Also, computer 10 generates additional video displays for the supervisor. As an example, the supervisor's master video display can show for the tandem machines the product they are producing, their current operational status, and the estimated output they will produce at shift's end based on their past performance and current efficiency. Further supervisor displays are available which show a comparison for each quality and quantity parameter of the product being produced by the like machines. For example, for each cigarette making machine being supervised, the percent of product rejection for such reasons as circumference out of tolerance, weight too heavy, weight too light, pressure drop out of tolerance, loose ends, and missing filters is displayed. For each cigarette packaging machine, the packaging waste is displayed.

As in the discussion of FIGS. 1 and 2, computer 10 can be programmed to monitor the performance of many sets of tandem machines. This operation would be the same for tandem machines as was discussed for the like machines of FIG. 2.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A method for improving the quality of products produced in a cigarette manufacturing process by machines operating in tandem, which comprises the steps of:

a. retrieving from a database expected baseline values of product quality parameters and machine operating parameters for a product selected by an operator of at least one set of tandem machines from a plurality of supported products produced by said at least one set of tandem machines;

b. monitoring by a computer of selected data representing machine operating parameters of said at least one set of tandem machines to provide an historical footprint for each unique machine of said at least one set of tandem machines and storing said selected data in said database;

c. automatically directing the obtaining of samples at preselected time intervals of the products being produced by said at least one set of tandem machines on a sequential basis as directed by said computer;

d. automatically testing quality parameters of the product produced by said manufacturing process utilizing a plurality of sensing devices as directed by said computer to obtain data representing said quality parameters to provide said historical footprint for each unique machine of said at least one set of tandem machines and storing by said computer of said sensed values to said database;

e. evaluating in real time by said computer said stored data representing said machine operating parameters and said stored data representing said product quality parameters to determine if said parameters fall outside of said retrieved baseline values or if said parameters have fallen outside of said historical footprint of each unique machine and if so, enabling said computer to:

(i) notify the operator, in real time, of said at least one set of tandem machines of an error condition when said sensed values fall outside of said retrieved expected values, (ii) recommend possible solutions to said operator of said at least one set of tandem machines for correcting the error condition, (iii) resequence said testing of quality parameters whenever said data representing sensed values falls outside of said historical footprint of each unique machine;

f. tracking by said computer for said at least one set of tandem machines the time period and downtime reason when said at least one set of tandem machines is inoperative;

g. generating by said computer a hierarchial set of video displays to provide information to the operators of said at least one set of tandem machines; and, h. displaying a master video display to the operator of said at least one set of tandem machines, said display showing the operational status, the product being produced, estimated production of the machine operator's machine and the other machine operating in tandem with it along with said quality parameters and said historical data generated by said computer means.

2. The method of claim 1, further comprising the step of: notifying each machine operator of said at least one set of tandem machines through said master video display when it is time for the operator to manually test samples of the product for said product quality parameters.

3. The method of claim 1, further comprising the step of: responding to a request by the operator of one machine of said at least one set of tandem machines to said computer to automatically test a requested product quality parameter for a product sample.

4. The method of claim 3, further comprising the step of responding to a request by the operator of one machine of said at least one set of tandem machines by said computer to manually test a requested quality parameter for a product sample, wherein said request may also be a manual test.

5. The method of claim 1, wherein the step of evaluating in real time by said computer said stored data representing said machine operating parameters and said stored data representing said product quality parameters includes computing statistical averages and standard deviations which are further utilized in determining when said sensed test measurements fall outside of said historical footprint of each unique machine which may cause said computing means to resequence tests for an increased frequency of testing or take other operative steps to inform the operator of said manufacturing machine of said change in said sensed test measurements.

6. The method of claim 1, further including the step of: calculating derivative quality parameters which are derived from the data from a plurality of tests.

7. The method of claim 1, further comprising the step of: displaying a master video display to a supervisor of said at least one set of tandem machines, said master video display showing for each machine in said at least one set of tandem machines and for the machines operating in tandem as a system, the operational status of said at least set of tandem machines, the product each machine of said at least one set of tandem machines is producing, and the estimated production of said at least one set of tandem machines.

8. The method of claim 7, further comprising the step of: allowing the supervisor to retrieve additional video displays form the hierarchial set of video displays for said at least one set of tandem machines which also provides a comparison of said multiple manufacturing machines and a display of comparative measurements of said machine operating parameters and said product quality parameters for each of said unique machines.

9. The method of claim 1, further comprising the step of monitoring by said computer of various materials being used to produce the products produced by said machines operating in tandem.

10. The method of claim 9, wherein the step of monitoring by said computer o various materials being used to produce the products produced by said machines operating in tandem includes the use of at least one bar code reader which the operator uses to indicate the source materials for the current product by scanning a representative material bar code, said computer notifying the operator when a wrong material selection has been made.

11. The method of claim 1, further comprising the step of: tracking for said at least one set of tandem machines the time period and alarm condition when the machine operating parameters for said at least one set of tandem machines fail to meet said expected baseline operating parameter values and when said machine operating parameters for said at least one set of tandem machines fall outside said historical footprint for each of said unique machine.

12. The method of claim 1, further comprising the step of: tracking for said at least one set of tandem machines the time period when there is a production malfunction causing said at least one set of tandem machines to cease production.

13. The method of claim 1, further comprising the step of: tracking for said at least one set of tandem machines the time period when the product quality test measurements for said at least one set of tandem machines fail to meet said expected baseline product quality values and when said product quality test measurements for said at least one set of tandem machines fall outside said historical footprint for each of said unique machine.

14. The method of claim 1, wherein the step of displaying a master video display to the operator of said at least one set of tandem machines, said display shows the operational status, the product being produced, and the estimated production of the machine operator's machine and the other machine operating in tandem with it, said display further includes:

a. highlighting out of tolerance conditions;
b. showing the most important current alarm condition or downtime reason, if applicable; and
c. allowing each machine operator of said at least one set of tandem machines to touch appropriate points on the master display to retrieve additional video displays from the hierarchial set of video displays which will provide more specific information.

15. The method of claim 14, wherein the more specific information obtainable by allowing each machine operator of said at least one set of tandem machines to touch appropriate points on the master display to retrieve additional video displays from the hierarchial set of video displays which will provide more specific information further included in the step of displaying a master video display to each machine operator of said at least one set of tandem machines, said display showing the operational status, the product being produced, and the estimated production of the machine operator's machine and the other machine operating in tandem with it includes:

a. the machine operating parameters for each product;
b. the materials which should be used for each product;
c. a summary of past alarm conditions;
d. a summary of each of the past quality parameters tested or derived;
e. a graphical summary of the past statistical average and standard deviation for each of the past quality parameters tested or derived;
f. a summary of the past downtime reasons; and,
g. suggested employee solution procedures to correct problems or out of tolerance conditions.

16. The method of claim 1, wherein in the step of displaying a master video display to the operator of said at least one set of tandem machines, said display shows the operational status, the product being produced, and the estimated production of the machine operator's machine and the other machine operating in tandem with it, said master video display for each machine being arranged differently such that the operator of each machine will prominently see what is displayed for his machine while also seeing what is displayed for the machine working in tandem with his machine.

17. The method of claim 1, wherein the step of evaluating in real time by said computer includes the tracking by product of all products produced on said at least one set of tandem machines.

18. The method of claim 1, wherein the product quality parameters tested are selected form the group consisting of filter rod circumference, filter pressure drop, filter wet weight and filter dry weight, cigarette weight, cigarette circumference, cigarette ventilation, cigarette pressure drop, and package seal pressure.

* * * * *

UNITED STATES PATENT AND TRADEMARK OFFICE

CERTIFICATE OF CORRECTION

PATENT NO. : 5,284,164

DATED : February 8, 1994

INVENTOR(S) : Andrews, Bricker, Collins, Jewell, Sinksen, Stephens, Wysowski

It is certified that error appears in the above-indentified patent and that said Letters Patent is hereby corrected as shown below:

Column 13, Line 18, after"by said computer" and before "various" insert "--of--" and delete "o".

Signed and Sealed this

Nineteenth Day of July, 1994

*Attest:*

*Attesting Officer*

BRUCE LEHMAN

*Commissioner of Patents and Trademarks*